US009742055B2

(12) United States Patent
Yan et al.

(10) Patent No.: US 9,742,055 B2
(45) Date of Patent: Aug. 22, 2017

(54) ANTENNA AND ELECTRONIC EQUIPMENT USING SAME

(71) Applicant: Xiaomi Inc., Beijing (CN)

(72) Inventors: Anna Xing Yan, Beijing (CN); Xiaodong Zhu, Beijing (CN); Shengxiang Cheng, Beijing (CN)

(73) Assignee: Xiaomi Inc., Beijing (CN)

( * ) Notice: Subject to any disclaimer, the term of this patent is extended or adjusted under 35 U.S.C. 154(b) by 137 days.

(21) Appl. No.: 14/587,050

(22) Filed: Dec. 31, 2014

(65) Prior Publication Data

US 2015/0364810 A1 Dec. 17, 2015

Related U.S. Application Data

(63) Continuation of application No. PCT/CN2014/089295, filed on Oct. 23, 2014.

(30) Foreign Application Priority Data

Jun. 11, 2014 (CN) ..... 2014 1 0256780

(51) Int. Cl.

| | |
|---|---|
| ***H01Q 1/24*** | (2006.01) |
| ***H01Q 1/22*** | (2006.01) |
| ***H01Q 13/16*** | (2006.01) |
| ***H01Q 13/10*** | (2006.01) |
| ***H01Q 5/371*** | (2015.01) |
| ***H01Q 1/12*** | (2006.01) |

(Continued)

(52) U.S. Cl.

CPC ..... *H01Q 1/22* (2013.01); *H01Q 1/1221* (2013.01); *H01Q 5/371* (2015.01); *H01Q 13/10* (2013.01); *H01Q 13/16* (2013.01); *H01Q 21/28* (2013.01); *H01Q 1/521* (2013.01)

(58) Field of Classification Search

CPC ..... H01Q 13/10; H01Q 1/22; H01Q 5/371; H01Q 1/1221; H01Q 13/16; H01Q 21/28

USPC ..... 343/718, 767, 893, 700 MS

See application file for complete search history.

(56) References Cited

U.S. PATENT DOCUMENTS 6,836,246 B1 * 12/2004 Kadambi ..... H01Q 1/243 343/700 MS 8,593,358 B2 11/2013 Rappaport (Continued)

FOREIGN PATENT DOCUMENTS

CN 200976392 Y 11/2007

CN 201345425 Y 11/2009

(Continued)

OTHER PUBLICATIONS

International Search Report of PCT/CN2014/089295, from the State Intellectual Property Office of China, mailed Feb. 11, 2015.

(Continued)

*Primary Examiner* — Graham Smith

*Assistant Examiner* — Jae Kim

(74) *Attorney, Agent, or Firm* — Finnegan, Henderson, Farabow, Garrett & Dunner LLP

(57) ABSTRACT

An antenna component for use in an antenna of electronic equipment, includes: a fastening part configured to connect with a metal plate in the electronic equipment, to make the metal plate serve as a part of the antenna component; and a radiator part connected to the fastening part and configured to generate antenna resonances in at least one frequency band.

15 Claims, 11 Drawing Sheets

(51) Int. Cl.
*H01Q 21/28* (2006.01)
*H01Q 1/52* (2006.01)

(56) References Cited

U.S. PATENT DOCUMENTS

| | | | | |
|---|---|---|---|---|
| 2003/0124985 | A1 | 7/2003 | Shin et al. | |
| 2004/0263402 | A1 | 12/2004 | Hung et al. | |
| 2007/0120753 | A1 | 5/2007 | Hung et al. | |
| 2008/0266186 | A1* | 10/2008 | Tai | H01Q 1/2266 343/700 MS |
| 2010/0194651 | A1 | 8/2010 | Huang | |
| 2011/0215971 | A1* | 9/2011 | Rao | H01Q 1/243 343/702 |
| 2013/0044036 | A1 | 2/2013 | Kuonanoja | |
| 2013/0106660 | A1 | 5/2013 | Kang | |
| 2013/0207854 | A1 | 8/2013 | Ryu | |
| 2014/0139386 | A1 | 5/2014 | Liu et al. | |

FOREIGN PATENT DOCUMENTS

| | | | |
|---|---|---|---|
| CN | 102714353 | A | 10/2012 |
| CN | 203289422 | U | 11/2013 |
| CN | 103545610 | A | 1/2014 |
| CN | 103688408 | A | 3/2014 |
| CN | 104078763 | A | 10/2014 |
| EP | 2573873 | A1 | 3/2013 |
| JP | 2010183225 | A | 8/2010 |
| JP | 2011155531 | A | 8/2011 |
| JP | 2011527151 | A | 10/2011 |
| JP | 2012191406 | A | 10/2012 |
| KR | 1990004343 | | 5/1990 |
| KR | 1020080097813 | | 11/2008 |
| KR | 1020090051954 | | 5/2009 |
| KR | 20100064008 | A | 6/2010 |
| RU | 2276822 | C2 | 5/2006 |
| RU | 2322734 | C1 | 4/2008 |
| RU | 2361599 | C2 | 2/2010 |
| WO | WO 2009/115986 | A1 | 9/2009 |
| WO | WO 2011/145323 | A1 | 11/2011 |
| WO | WO 2013/012404 | A1 | 1/2013 |
| WO | WO 2013/060683 | A1 | 5/2013 |
| WO | WO 2014/059382 | A1 | 4/2014 |
| WO | WO 2014/074948 | A1 | 5/2014 |

OTHER PUBLICATIONS

Extended Search Report for European Application No. EP 15170252.9 from the European Patent Office, dated Sep. 22, 2015.

English Version of International Search Report of PCT/CN2014/089295, from the State Intellectual Property Office of China, mailed Feb. 11, 2015.

* cited by examiner

ANTENNA AND ELECTRONIC EQUIPMENT USING SAME

CROSS-REFERENCE TO RELATED APPLICATIONS

This application is a Continuation Application of International Application No. PCT/CN2014/089295, filed Oct. 23, 2014, which is based upon and claims priority to Chinese Patent Application No. CN201410256780.6, filed on Jun. 11, 2014, the entire contents of all of which are incorporated herein by reference.

TECHNICAL FIELD

The present disclosure generally relates to the field of antennas and, more particularly, to a MIMO antenna and electronic equipment using the MIMO antenna.

BACKGROUND

A multiple-input multiple-output (MIMO) antenna can provide a high data transmission rate. Conventionally, the MIMO antenna includes two antenna components that are bilateral symmetrical to each other. The MIMO antenna can be connected to electronic equipment through an external cable. Generally, the MIMO antenna occupies a large space and may need to use a large amount of material to manufacture. As a result, the manufacture cost can be high.

SUMMARY

According to a first aspect of the present disclosure, there is provided an antenna component for use in an antenna of electronic equipment, comprising; a fastening part configured to connect with a metal plate in the electronic equipment, to make the metal plate serve as a part of the antenna component; and a radiator part connected to the fastening part and configured to generate antenna resonances in at least one frequency band.

According to a second aspect of the present disclosure, there is provided an antenna for use in electronic equipment, comprising: a first antenna component; and a second antenna component symmetrical to the first antenna component, wherein at least one of the first antenna component and the second antenna component includes: a fastening part configured to connect with a metal plate in the electronic equipment, to make the metal plate serve as a part of the antenna component; and a radiator part connected to the fastening part and configured to generate antenna resonances in at least one frequency band.

According to a third aspect of the present disclosure, there is provided electronic equipment, comprising: a processor; and an antenna coupled to the processor, and including a first antenna component and a second antenna component symmetrical to the first antenna component, wherein at least one of the first antenna component and the second antenna component includes; a fastening part configured to connect with a metal plate in the electronic equipment, to make the metal plate serve as a part of the antenna component; and a radiator part connected to the fastening part and configured to generate antenna resonances in at least one frequency band.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DESCRIPTION OF THE EMBODIMENTS

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

Figure 1:
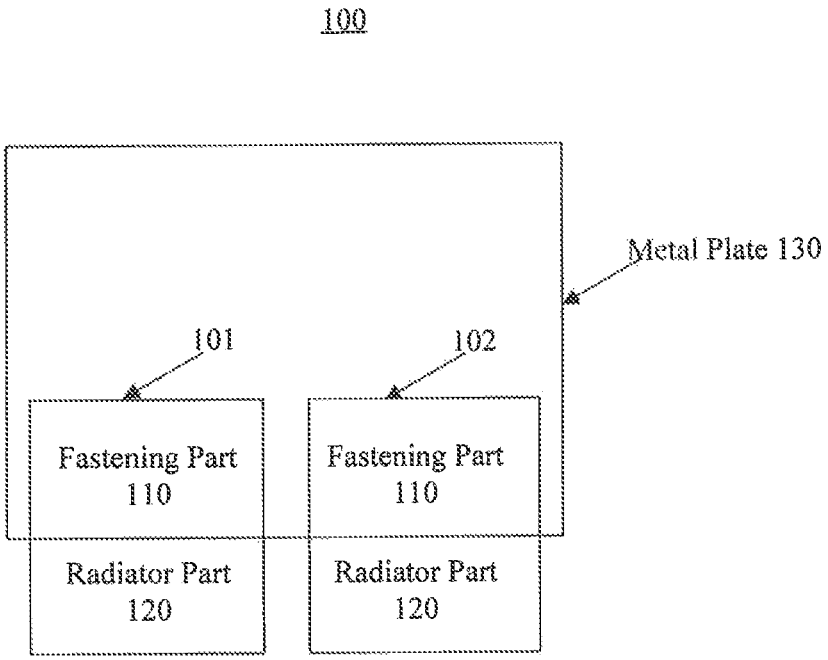
FIG. 1 is a schematic diagram of an antenna, according to an exemplary embodiment.

FIG. 1 is a schematic diagram of an antenna 100, according to an exemplary embodiment. For example, the antenna 100 is a multiple-input multiple-output (MIMO) antenna. Referring to FIG. 1, the antenna 100 includes first and second antenna components 101 and 102, which may be symmetrical to each other.

In exemplary embodiments, each antenna component 101 or 102 includes a fastening part 110 and a radiator part 120 connected to the fastening part 110. The fastening part 110 is tightly connected with a metal plate 130 in electronic equipment using the antenna 100, to make the metal plate 130 serve as a part of the antenna component 101 or 102. The radiator part 120 is configured to generate antenna resonances in at least one frequency band. In one exemplary embodiment, the antenna components 101 and 102 are symmetrical to each other.

Figure 2A:
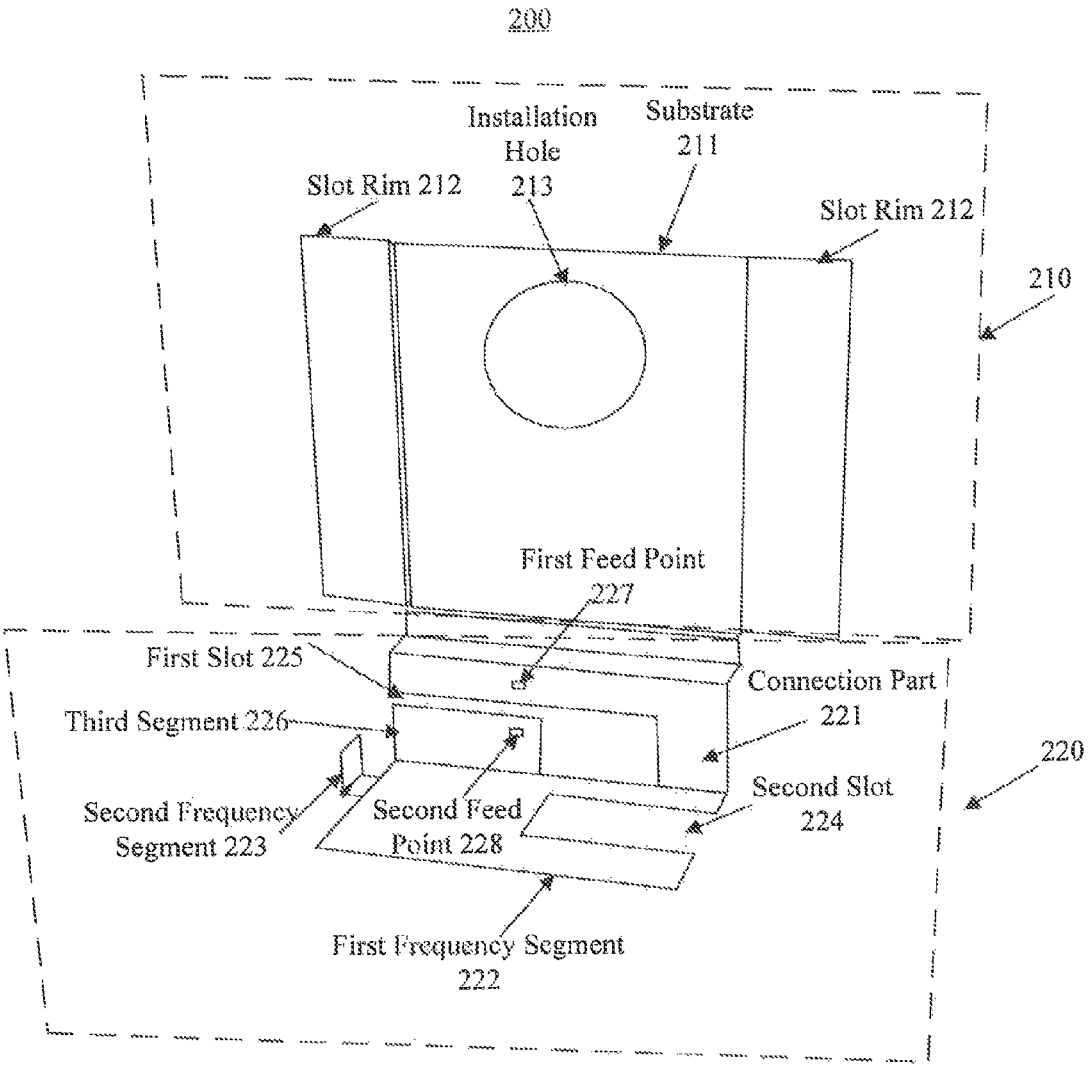
FIG. 2A is a schematic diagram of an antenna component in an antenna, according to an exemplary embodiment.

FIG. 2A is a schematic diagram of an antenna component 200, according to an exemplary embodiment. For example, the antenna component 200 may be the antenna component 101 or the antenna component 102 (FIG. 1). Referring to FIG. 2A, the antenna component 200 includes a fastening part 210 and a radiator part 220 connected to the fastening part 210.

In exemplary embodiments, the fastening part 210 is tightly connected with a metal plate (not shown) in electronic equipment that uses an antenna, such as an MIMO antenna, including the antenna component 200, to make the metal plate serve as a part of the antenna component 200. The fastening part 210 may be formed through stamping a piece of metal, such as copper-nickel alloy, with a thickness of 0.3a, where a is a length unit. In an actual implementation, the fastening part 210 may also be made of other materials or formed through stamping a metal plate with a different thickness, which is not limited in the present disclosure. The metal plate 230 in the electronic equipment may be a backplane of the electronic equipment, which is not limited in the present disclosure. By using the metal plate in the electronic equipment as a part of the antenna component 200, the radiation efficiency of the antenna can be improved.

In exemplary embodiments, the fastening part 210 includes a substrate 211 parallel to the metal plate, and first and second slot rims 212 formed by extending along first and second sides of the substrate 211 respectively.

In addition, at least one installation hole 213 is formed on the substrate 211, and the substrate may be tightly connected with the metal plate through the installation hole 213. The installation hole 213 is used to connect the fastening part 210 to the metal plate through a fixing component. Moreover, the installation hole 213 may be a round hole as shown in FIG. 2, and may instead be a hole with another shape such as a rectangle, oval, or trapezoidal, which is not limited in the present disclosure. The fixing component is a component used for fixation, such as a screw and the like.

In exemplary embodiments, the radiator part 220 is configured to generate antenna resonances in at least one frequency band.

In one exemplary embodiment, the metal plate of the electronic equipment using the MIMO antenna serves as a part of the antenna component 200, which may improve the radiant efficiency of the MIMO antenna, and reduce the material for producing the radiator part 220, and thus reduce the cost of the MIMO antenna.

In exemplary embodiments, the radiator part 220 is formed through stamping a piece of metal, such as copper-nickel alloy, with a thickness of 0.3a, where a is a length unit. In an actual implementation, the radiator part 220 may also be made of other materials or through stamping a metal plate with a different thickness, which is not limited in the present disclosure. In addition, the radiator part 220 and the fastening part 210 may be made by two parts of one piece of copper-nickel alloy formed after being stamped and bended, which is not limited in the present disclosure.

In exemplary embodiments, the radiator part 220 includes at least one frequency segment configured to generate antenna resonance in a corresponding frequency band. In the illustrated embodiment, the radiator part 220 includes first and second frequency segments. For example, the radiator part 220 includes a connection part 221 formed by bending the fastening part 210 to extend in a plane parallel to the metal plate, a first frequency segment 222 formed by bending the connection part 221 and extending along a plane vertical to the metal plate, the first frequency segment 222 being configured to generate antenna resonance in, e.g., the 2.4 GHz~2.5 GHz frequency band, and a second frequency segment 223 formed by extending from a first side of the first frequency segment 222 that is vertical to the metal plate. The second frequency segment 223 is vertical to both the metal plate and the first frequency segment 222, and is configured to generate antenna resonance in, e.g., the 5.1 GHz~5.8 GHz frequency band.

In exemplary embodiments, a first slot 225 is formed in the connection part 221, and a second slot 224 is formed to extend from the middle of a second side of the first frequency segment 222.

Figure 2B:
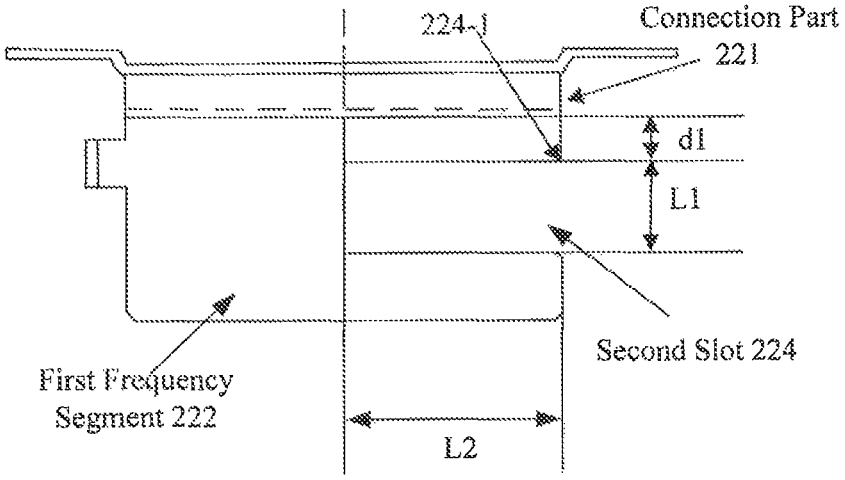
FIG. 2B is a schematic diagram of a slot in an antenna component, according to an exemplary embodiment.

FIG. 2B is a schematic diagram of the second slot 224, according to an exemplary embodiment. Referring to FIG. 2B, the second slot 224 may be a rectangular slot with a length L1 and a width L2. The length L1 starts from a position 224-1 on the second side of the first frequency segment 222 which is located d1 away from a connection side of the connection part 221 and the first frequency segment 222, and the width L2 extends from the position 224-1 to a center line of the first frequency segment 222. The sum of L1 and d1 is smaller than the length of the second side of the first frequency segment 222, and L2 is smaller than the length of a third side of the first frequency segment 222 that is parallel to the metal plate. In actual implementations, the second slot 224 may be a slot with other shapes or sizes, which is not limited in the present disclosure.

Referring back to FIG. 2A, the first slot 225 is formed in the connection part 221, so that a third segment 226 is formed at the side of the connection part 221 that is adjacent to the second frequency segment 223. The third segment 226 is configured to generate distributed capacitance with the second frequency segment 223 and ground, respectively.

Figure 2C:
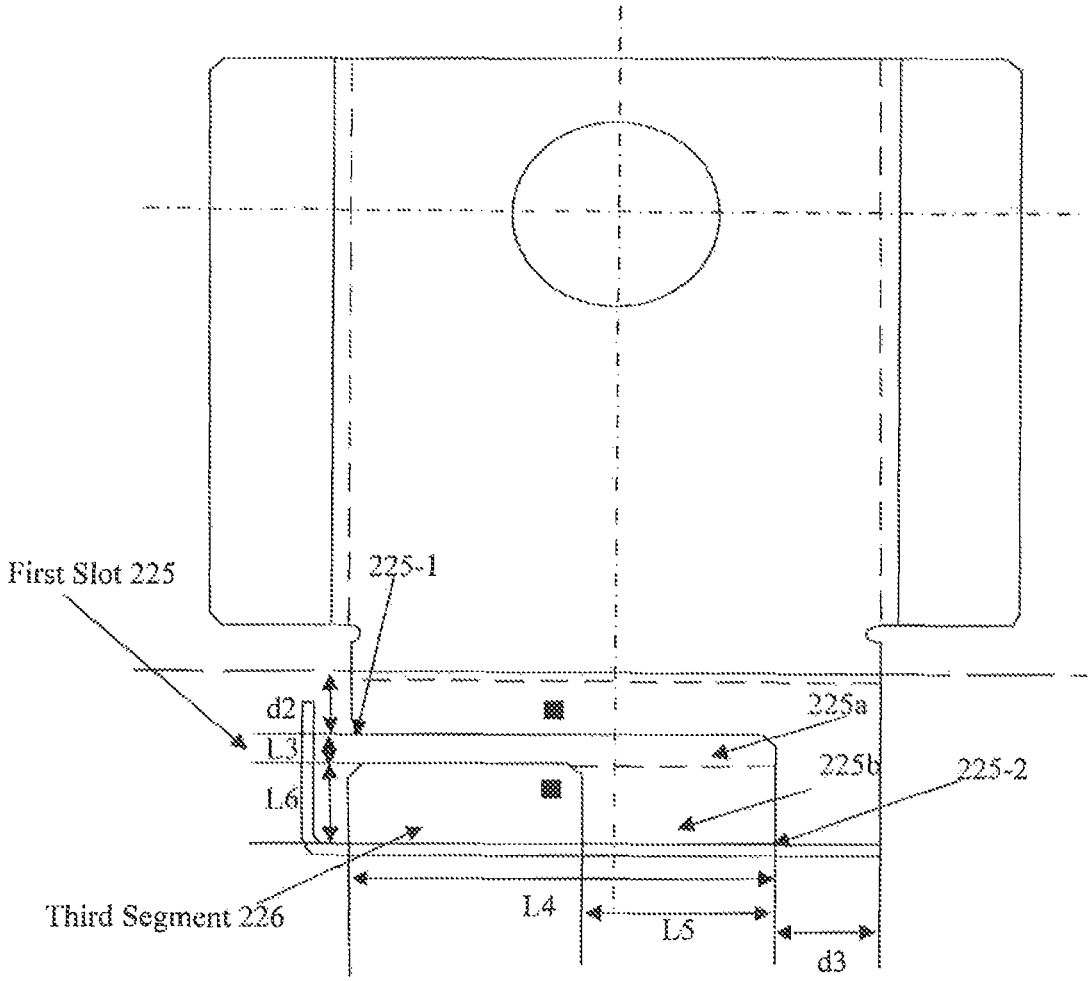
FIG. 2C is a schematic diagram of a slot in an antenna component, according to an exemplary embodiment.

FIG. 2C is a schematic diagram of the first slot 225, according to an exemplary embodiment. Referring to FIG. 2C, the first slot 225 includes a first rectangle slot 225*a* and a second rectangle slot 225*b*. The first rectangle slot 225*a* may be a slot with a width L3 and a length L4. The width L3 starts from a position 225-1 on a first side of the connection part 221 which is vertical to the connection side of the connection part 221 and the first frequency segment 222, and is located d2 away from a side of the connection part 221 that is opposite to the connection side, and the length L4 extends from the position 225-1 and beyond a center line of the connection part 221. The second rectangle slot 225*b* is a slot with a width L5 and a length L6. The second rectangle slot 225*b* is obtained through extending a distance L5 from a position 225-2 which is on the connection side of the connection part 221 and the first frequency segment 222 and is located d3 away a second side of the connection part 221 that is vertical to the connection side, and extending a distance L6 from the position 225-2 towards the side the connection part 221 that is opposite to the connection side. The sum of L4 and d3 is equal to the length of the connection side of the connection part 221 and the first frequency segment 222, and the sum of L3, L6 and d2 is equal to the length of the first side of the connection part 221 which is vertical to the connection side. In an actual implementation, the first slot 225 may be a slot with other shapes or sizes, which is not limited in the present disclosure. Furthermore, the third segment 226 has an area L6*(L4–L5), which is obtained after the first slot 225 is formed in the connection part 221.

Referring back to FIG. 2A, in exemplary embodiments, the distributed capacitance generated between the third segment 226 and ground is mainly used for antenna matching, so that the electromagnetic energy inputted into the antenna component 200 is radiated out as much as possible, rather than is stored in the antenna component 200, so as to improve the radiation efficiency of the antenna. Meanwhile, through the distributed capacitance between the third segment 226 and ground, a magnetic resistance introduced by the metal plate of the electronic equipment can be overcome, and the effects of the metal plate of the electronic equipment to the antenna component 200 can be avoided.

In exemplary embodiments, the distributed capacitance between the third segment 226 and the second frequency segment 223 mainly serves to counteract a magnetic coupling between two antenna components of the MIMO antenna, such as the antenna components 101 and 102 (FIG. 1), so as to improve the isolation between the two antenna components.

In exemplary embodiments, a first feed point 227 is formed in the connection part 221 and a second feed point 228 is formed in the third segment 226. The first feed point 227 is located away from a first side of the first slot 225, and the second feed point 228 is located away from a second side of the first slot 225 and may be symmetric with respect to the first feed point 227. The first feed point 227 and the second feed point 228 may use parallel-paired lines or coaxial lines for feeding.

Figure 2D:
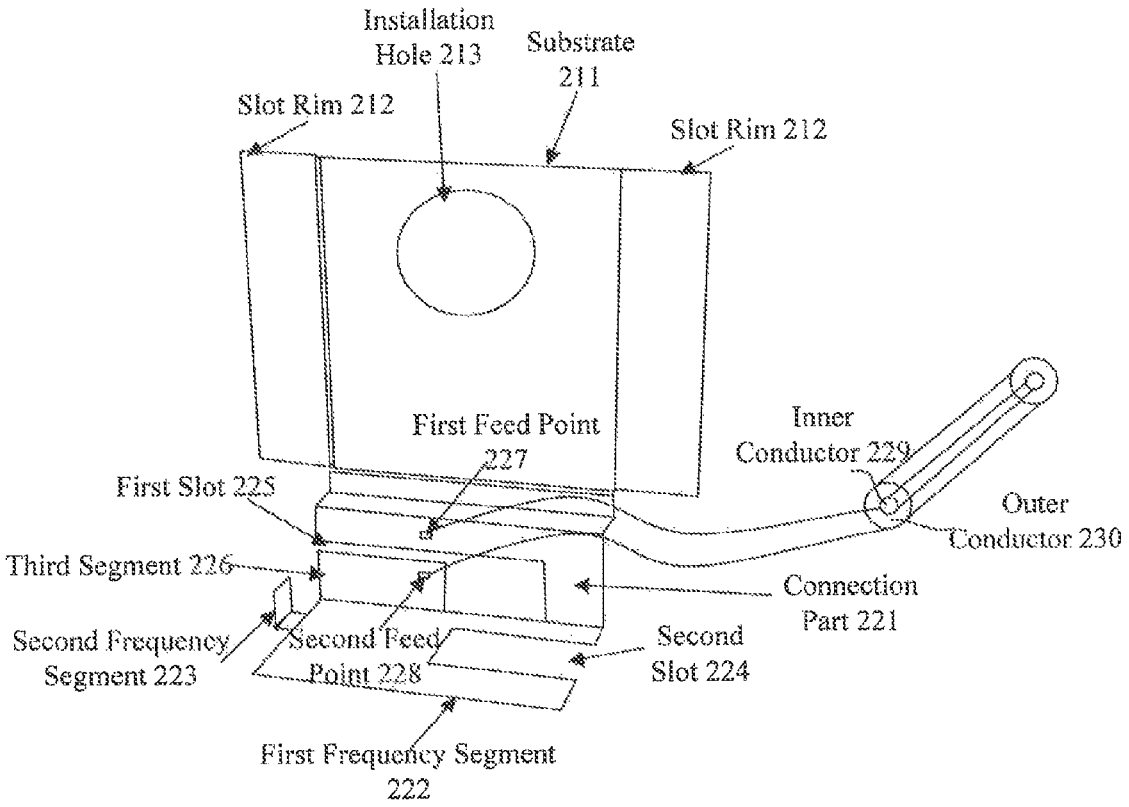
FIG. 2D is a schematic diagram of a feed point in an antenna component being connected to a coaxial line, according to an exemplary embodiment.

FIG. 2D is a schematic diagram of the feed points 227 and 228 being connected to a coaxial line, according to an exemplary embodiment. Referring to FIG. 2D, the first feed point 227 is electrically connected to an inner conductor 229 of the coaxial line, and the second feed point 228 is electrically connected to an outer conductor 230 of the coaxial supply line. In the illustrated embodiment, the shapes of the first feed point 227 and the second feed point 228 are rectangular. In an actual implementation, the shapes may be other regular shapes such as circle, triangle and oval, or irregular shapes.

Figure 2E:
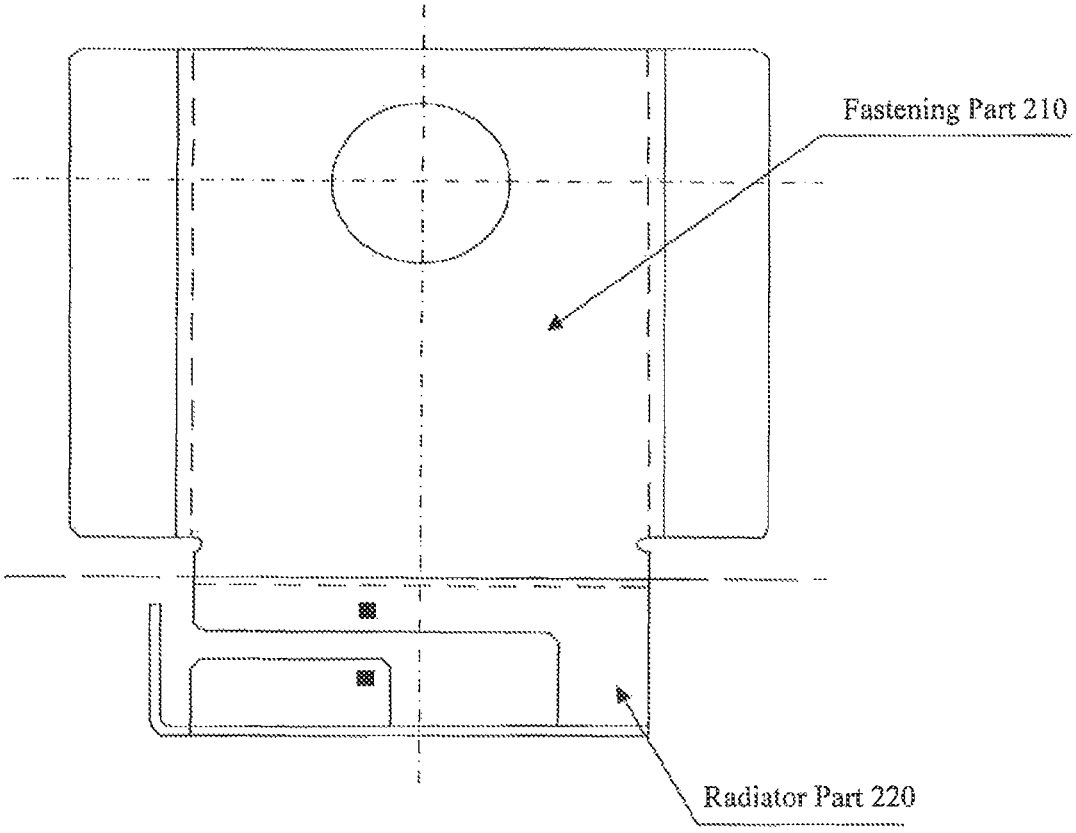
FIG. 2E, is a schematic diagram of an antenna component, according to an exemplary embodiment.

FIG. 2E is a schematic diagram of the fastening part 210 and the radiator part 220 in the antenna component 200, according to an exemplary embodiment. Referring to FIG. 2E, the schematic diagram shows the fastening part 210 and the radiator part 220 in the antenna component 200 in a front view.

In the illustrated embodiments, the radiator part 220 includes first and second frequency segments. In an actual implementation, if the antenna component 200 needs to generate antenna resonance in additional frequency bands, the radiator part 220 may include additional frequency segments corresponding to the additional frequency bands, respectively. For example, if the antenna component 200 needs to generate antenna resonance in a third frequency band of, e.g., 3.4 GHz~3.6 GHz, the radiator part 220 may include a third frequency segment to generate antenna resonance in the 3.4 GHz~3.6 GHz frequency band.

The antenna component 200 can save material used in the MIMO antenna by making the metal plate in the electronic equipment serve as a part of the antenna, so that the cost of the MIMO antennas can be reduced.

Figure 3:
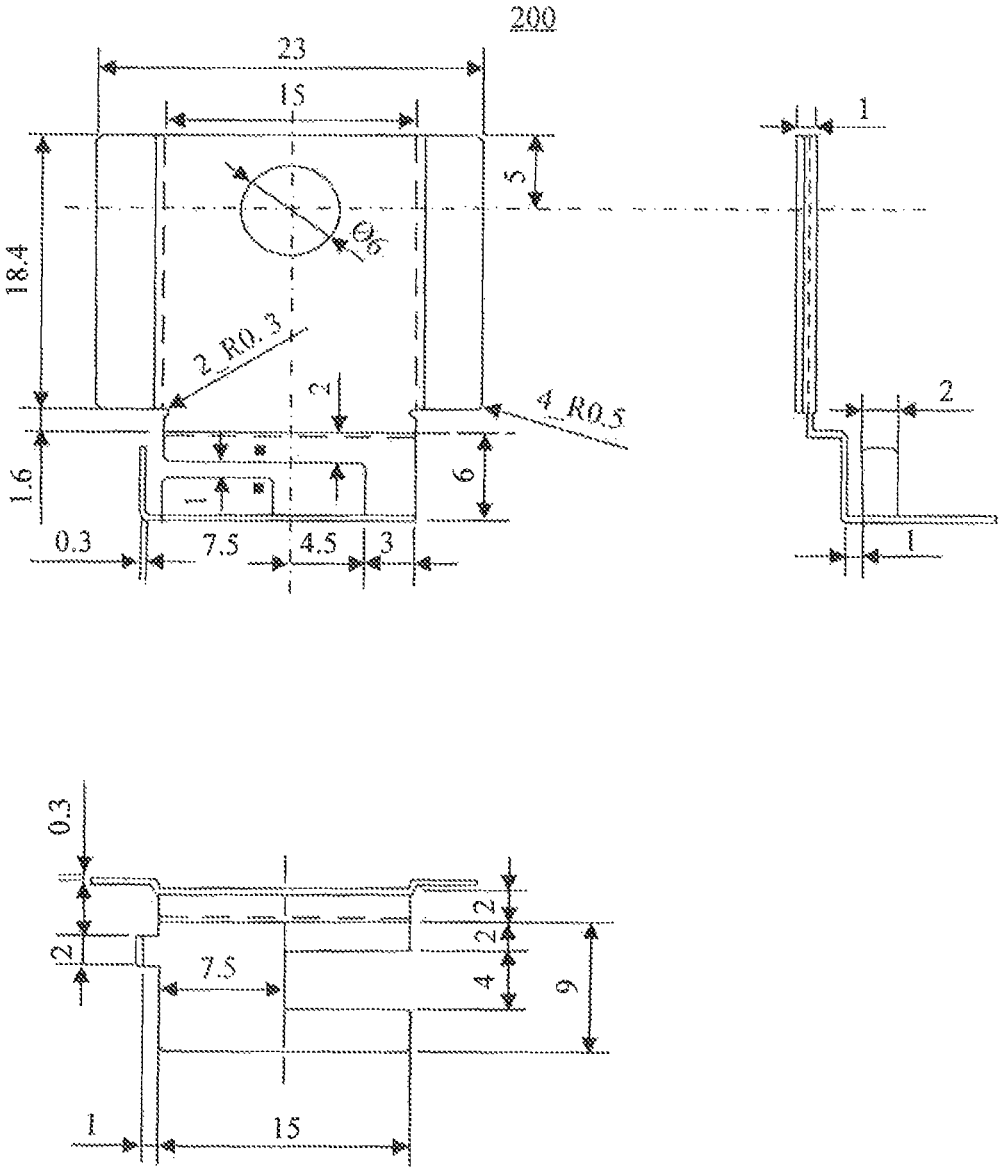
FIG. 3 is a specification diagram of an antenna component, according to an exemplary embodiment.

FIG. 3 is a specification diagram of the antenna component 200 (FIG. 2A), according to an exemplary embodiment. Specifically, FIG. 3 shows plan, side, and end views of the antenna component 200. A size of each part of the antenna component 200 is shown in FIG. 3, where the unit of the size of each part is the length unit a. In an actual implementation, a may be millimeter (mm), which is not limited in the present disclosure.

Referring to FIGS. 2A and 3, the antenna 200 includes the fastening part 210 corresponding to a first rectangle and a second rectangle in FIG. 3. A length and a width of the first rectangle are 23a and 18.4a, respectively, and a length and a width of the second rectangle are 15a and 16a, respectively. The first and second slot rims 212 each have a length of 4a and a width of 18.4a, and are located at first and second sides of the first rectangle, respectively. Each slot rim 212 is bended with a bending depth of 0.4a along a direction vertical to the metal plate. The middle part of the first rectangle is a rectangle with a length of 15a and a width of 18.4a, corresponding to the substrate 211, and that rectangle includes the installation hole 213 with a radius of 3a. The center of the installation hole 213 is located at a perpendicular bisector of the side with the length of 15a, and is located a distance 5a away from that side with the length of 15a. The first rectangle has four, e.g., rounded corners each with a radius of 0.5a. At the junction of the second rectangle and the first rectangle, there are two rounded corners each with a radius of 0.3a, and the two rounded corners are curved to the symmetry axis. Because both the fastening part 210 and the connection part 221 are parallel to the metal plate and the connection part 221 is formed by bending the fastening part 210, a part corresponding to a rectangle with a width of 2a and a length of 15a is shown in FIG. 3, and is vertical to the fastening part 210 and the connection part 221 in the middle of them. In this embodiment, this part belongs to the fastening part 210, for example.

The connection part 221, the first slot 225, and the third segment 226 together form a rectangle with a length of 6a and a width of 15a. The connection part 221 includes two parts, corresponding to a third rectangle with a length of 15a and a width of 2a and a fourth rectangle with a length of 4a and a width of 3a, respectively. The first slot 225 corresponds to a fifth rectangle with a length of 12a and a width of 1a and a sixth rectangle with a length of 5.5a and a width of 3a. The third segment 226 corresponds to a rectangle with a length of 6a and a width of 3a. Moreover, the connection part 221 includes the first feed point 227 with a length of 0.5a and a width of 0.5a, and the third segment 226 includes the second feed point 228 with a length of 0.5a and a width of 0.5a. The distance between a first side of the first slot 225 and the first feed point 227 is 0.5a, and the distance between a second side of the first slot 225 parallel to the first side and the second feed point 228 is also 0.5a. In addition, the minimum distance between each of the first feed point 227 and the second feed point 228, and the perpendicular bisector in the first rectangle is 0.5a.

The frequency segment 222 and the second slot 224 together form a rectangle with a length of 9a and a width of 15a. The second slot 224 corresponds to a rectangle with a length of 4a and a width of 7.5a. A side of the second slot 224 with the length of 4a is on a perpendicular bisector of the side with the length of 15a of the rectangle with the length of 9a and the width of 15a. A distance between the side with the length of 7.5a and the connection side of the first frequency segment 222 and the connection part 221 is 2a. The second frequency segment 223 is obtained by extending from a side of the part corresponding to a rectangle with a length of 2a and a width of 1a.

Figure 4:
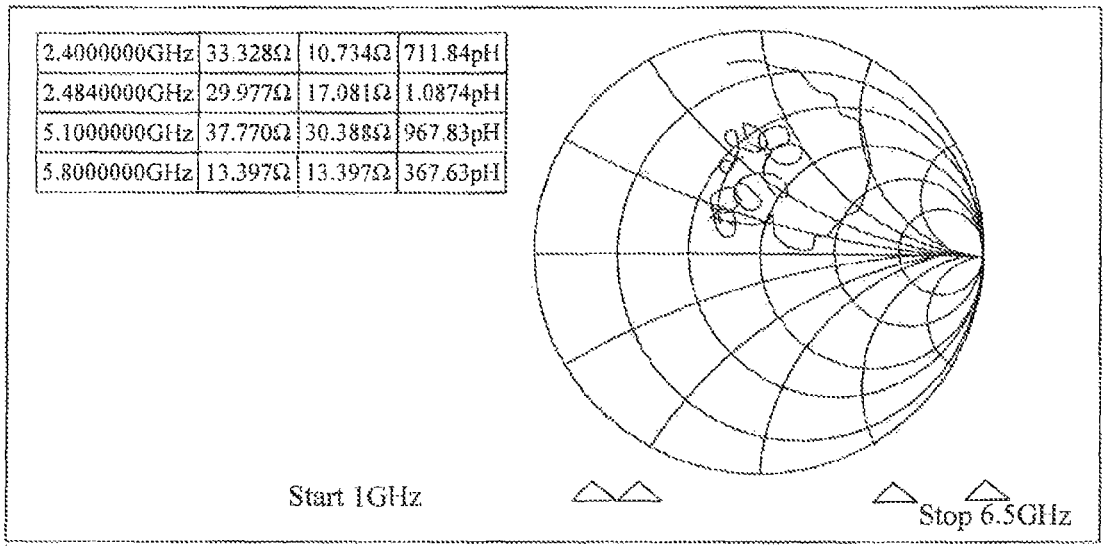
FIG. 4 shows an impedance circular chart of an antenna component, according to an exemplary embodiment.
Figure 5:
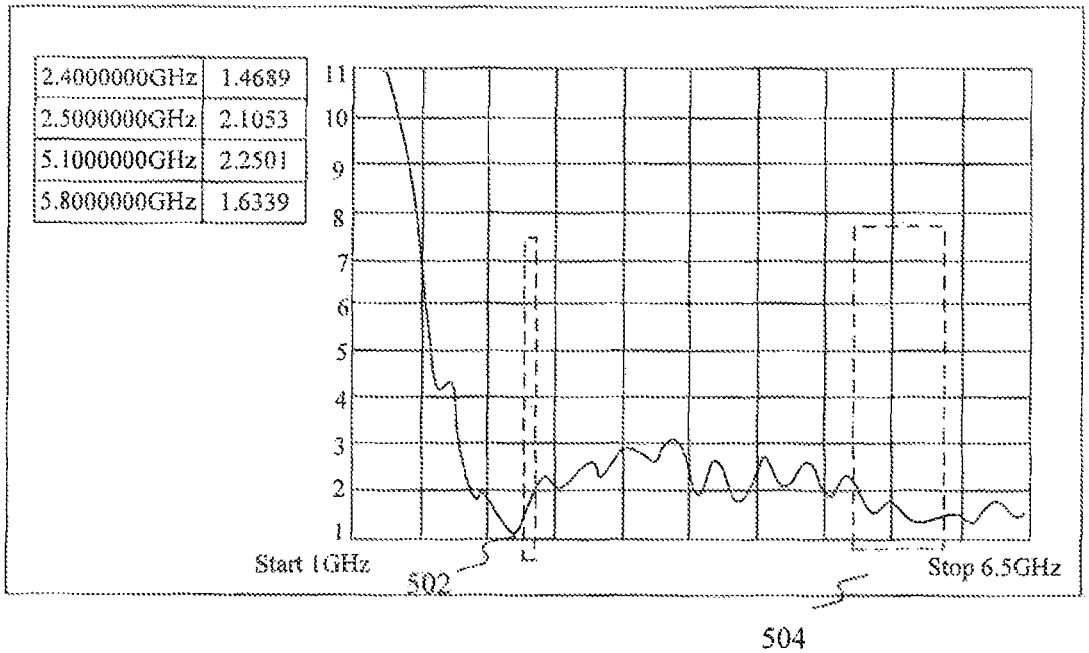
FIG. 5 shows an antenna standing wave ratio chart of an antenna component, according to an exemplary embodiment.

FIG. 4 shows an antenna impedance circle chart during testing of the MIMO antenna including the antenna component 200 (FIG. 3), according to an exemplary embodiment. FIG. 5 shows an antenna standing wave ratio chart during testing of the MIMO antenna including the antenna component 200 (FIG. 3), according to an exemplary embodiment. Referring to FIG. 5, in two frequency bands of 2.4 GHz~2.5 GHz (corresponding to a rectangle 502) and 5.1 GHz~5.8 GHz (corresponding to a rectangle 504), the standing wave ratios of the antenna component 200 are smaller than a threshold 3, therefore the antenna component 200 conforms to the requirement that the standing wave ratios be smaller than the threshold.

Figure 6:
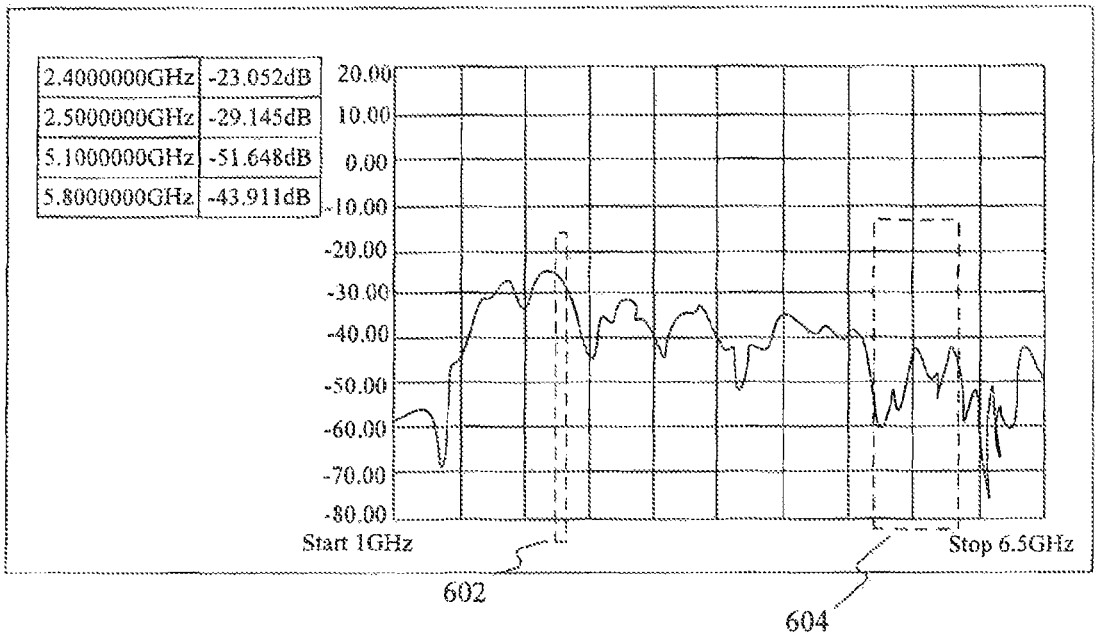
FIG. 6 is a chart showing isolation between antenna components, according to an exemplary embodiment.

FIG. 6 is a chart showing isolation between two antenna components when a distance between the two antenna components is 8 cm. Each abscissa of the coordinate system in FIG. 6 corresponds to a frequency, and each ordinate of the coordinate system in FIG. 6 corresponds to an isolation. Referring to FIG. 6, in the frequency band of 2.4 GHz~2.5 GHz, corresponding to a rectangle 602, the isolation between the two antenna components is more than 20 dB, and in the frequency band of 5.1 GHz~5.8 GHz, corresponding to a rectangle 604, the isolation between the two antenna components is more than 40 dB. Accordingly, in the illustrated embodiment, the MIMO antenna including the antenna components can meet a requirement of being more than 15 dB.

Figure 7:
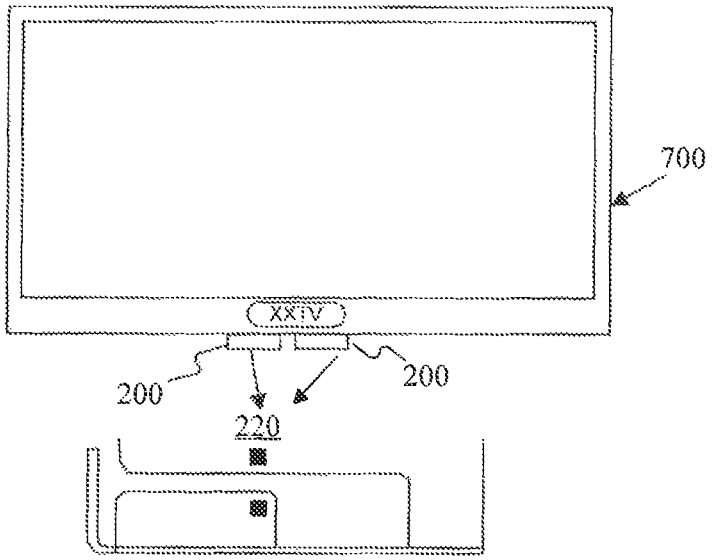
FIG. 7 is a schematic diagram of an antenna component installed in electronic equipment, according to an exemplary embodiment.

In exemplary embodiments, two antenna components in an MIMO antenna may be installed at the same side of the back of electronic equipment, which is not limited in the present disclosure. To improve the radiation efficiency of the antenna components, when the antenna components are installed, projections of the radiator parts of the antenna components and other parts of the electronic equipment may be made to not intersect each other on a plane of the electronic equipment facing a user. For example, on the plane of the electronic equipment facing the user, the radiator parts of the antenna components can be seen by the user. FIG. 7 is a schematic diagram of the radiator parts 220 of two antenna components that are exposed from a bottom side of electronic equipment 700, according to an exemplary embodiment. For example, the electronic equipment 700 includes a processor coupled to an antenna including, e.g., the two antenna components 200, to receive signals. The radiator parts 220 of the antenna components 200 can be seen by the user.

In exemplary embodiments, if a size of the electronic equipment using the MIMO antenna is too large or too small, a proportion of the antenna components can be adjusted appropriately, which is not limited in the present disclosure. For example, the electronic equipment may be a flat-panel television.

In the illustrated embodiments, various parts of the antenna component are vertical or parallel to each other. In an actual implementation, the angles formed by various parts of the antenna component may be varied. A parallel or vertical relation is used as an example in these embodiments, and specific degrees of the actual angles are not limited in the present disclosure. Moreover, when adopting a parallel or vertical relation, the user can easily detect deformation of the antenna component.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims;

What is claimed is:

1. An antenna component for use in an antenna of electronic equipment, comprising:

a fastening part configured to connect with a metal plate in the electronic equipment, to make the metal plate serve as a part of the antenna component, the fastening part including:

a substrate parallel to the metal plate; and first and second slot rims extending from first and second sides of the substrate, respectively;

wherein at least one installation hole is formed in the substrate, and the substrate is securely fixed to the metal plate through the installation hole; and a radiator part connected to the fastening part and configured to generate antenna resonances in at least one frequency band, the radiator part including:

a connection part extending in a plane parallel to the metal plate;

a first frequency segment extending in a plane vertical to the metal plate; and a second frequency segment extending from a first side, which is vertical to the metal plate, of the first frequency segment, the second frequency segment being vertical to both the metal plate and the first frequency segment;

wherein a first slot is formed in the connection part, and a third segment is formed at a side, which is adjacent to the second frequency segment, of the connection part, and a second slot extends from the middle of a second side, which is vertical to the metal plate, of the first frequency segment towards a center line of the first frequency segment.

2. The antenna component according to claim 1, wherein:

each of the first frequency segment and the second frequency segment is configured to generate antenna resonances in a corresponding frequency band.

3. The antenna component according to claim 2, wherein the third segment is configured to generate distributed capacitance between the second frequency segment and the third segment, and distributed capacitance between ground and the third segment.

4. The antenna component according to claim 3, wherein:

a first feed point is formed in the connection part, the first feed point being located away from a first side of the first slot; and a ground point is formed in the third segment, the ground point being located away from a second side of the first slot parallel to the first side and being symmetric with the first feed point with respect to a middle line in the first slot.

5. The antenna component according to claim 4, being configured to connect to a coaxial line, wherein the first feed point is electrically connected to an inner conductor of the coaxial line; and the ground point is electrically connected to an outer conductor of the coaxial line.

6. The antenna component according to claim 1, being configured for use in a multiple-input multiple-output (MIMO) antenna.

7. An antenna for use in electronic equipment, comprising:

a first antenna component; and a second antenna component, wherein at least one of the first antenna component and the second antenna component includes:

a fastening part configured to connect with a metal plate in the electronic equipment, to make the metal plate serve as a part of the antenna component, the fastening part including:

a substrate parallel to the metal plate; and first and second slot rims extending from first and second sides of the substrate, respectively;

wherein at least one installation hole is formed in the substrate, and the substrate is securely fixed to the metal plate through the installation hole; and a radiator part connected to the fastening part and configured to generate antenna resonances in at least one frequency band, the radiator part including:

a connection part extending in a plane parallel to the metal plate;

a first frequency segment extending in a plane vertical to the metal plate; and a second frequency segment extending from a first side, which is vertical to the metal plate, of the first frequency segment, the second frequency segment being vertical to both the metal plate and the first frequency segment;

wherein a first slot is formed in the connection part, and a third segment is formed at a side, which is adjacent to the second frequency segment, of the connection part, and a second slot extends from the middle of a second side, which is vertical to the metal plate, of the first frequency segment towards a center line of the first frequency segment.

8. The antenna according to claim 7, wherein:

each of the first frequency segment and the second frequency segment is configured to generate antenna resonances in a corresponding frequency band.

9. The antenna according to claim 8, wherein the third segment is configured to generate distributed capacitance between the second frequency segment and the third segment, and distributed capacitance between ground and the third segment.

10. The antenna according to claim 9, wherein:

a first feed point is formed in the connection part, the first feed point being located away from a first side of the first slot; and a ground point is formed in the third segment, the ground point being located away from a second side of the first slot parallel to the first side and being symmetric with the first feed point with respect to a middle line in the first slot.

11. The antenna according to claim 10, wherein the at least one of the first antenna component and the second antenna component is configured to connect to a coaxial line, wherein the first feed point is electrically connected to an inner conductor of the coaxial line; and the ground point is electrically connected to an outer conductor of the coaxial line.

12. The antenna according to claim 7, wherein the first and second antenna components are installed at a same side of the back of the electronic equipment, and projections of the radiator parts of the first and second antenna components, respectively, and at least one part of the electronic equipment do not intersect each other.

13. The antenna according to claim 7, being configured for use in a flat-panel television.

14. Electronic equipment, comprising:

a processor; and an antenna coupled to the processor, and including a first antenna component and a second antenna component, wherein at least one of the first antenna component and the second antenna component includes:

a fastening part configured to connect with a metal plate in the electronic equipment, to make the metal plate serve as a part of the antenna component, the fastening part including:

a substrate parallel to the metal plate; and first and second slot rims extending from first and second sides of the substrate, respectively;

wherein at least one installation hole is formed in the substrate, and the substrate is securely fixed to the metal plate through the installation hole; and a radiator part connected to the fastening part and configured to generate antenna resonances in at least one frequency band, the radiator part including:

a connection part extending in a plane parallel to the metal plate;

a first frequency segment extending in a plane vertical to the metal plate; and a second frequency segment extending from a first side, which is vertical to the metal plate, of the first frequency segment, the second frequency segment being vertical to both the metal plate and the first frequency segment;

wherein a first slot is formed in the connection part, and a third segment is formed at a side, which is adjacent to the second frequency segment, of the connection part, and a second slot extends from the middle of a second side, which is vertical to the metal plate, of the first frequency segment towards a center line of the first frequency segment.

15. The electronic equipment according to claim 14, being a flat-panel television.

* * * * *